United States Patent [19]

Miller

[11] 4,206,628

[45] Jun. 10, 1980

[54] PRESS WITH HYDRAULIC LOAD TRANSFERRING MECHANISM

[75] Inventor: Donald E. Miller, Mt. Prospect, Ill.

[73] Assignee: The Continental Group, Inc., New York, N.Y.

[21] Appl. No.: 21,284

[22] Filed: Mar. 16, 1979

[51] Int. Cl.[2] ..... B21J 9/10

[52] U.S. Cl. ..... 72/354; 72/450; 72/453.04; 72/453.18

[58] Field of Search ..... 72/354, 351, 352, 347, 72/358, 353, 450, 453.01, 453.04, 453.18

[56] References Cited

U.S. PATENT DOCUMENTS

| | | | |
|---|---|---|---|
| 2,417,794 | 3/1947 | Werner | 72/417 |
| 3,108,502 | 10/1963 | Chatfield | 72/354 |
| 3,138,257 | 6/1964 | Andersen | 72/431 |
| 3,456,478 | 7/1969 | Alexander | 72/351 |
| 3,861,191 | 1/1975 | Sato | 72/354 |

*Primary Examiner*—Francis S. Husar

*Assistant Examiner*—Gene P. Crosby

*Attorney, Agent, or Firm*—Charles E. Brown

[57] ABSTRACT

A forging press having a mechanical mechanism for reciprocating the ram and wherein the tooling includes a fixed die sleeve, a punch carried by the ram, and a pad movable through the die sleeve in conjunction with a slug being formed. The pad is supported by a forge cylinder which is coupled to the ram by one or more load cylinders. The area of the piston of the forge cylinder is greater than the combined areas of the pistons of the load cylinders so that as the pad descends hydraulic fluid is pumped from the forge cylinder through the load cylinders at a rate greater than that which can be received so that the hydraulic fluid is compressed to a high pressure, and this pressure is effective as a forging pressure between the punch and the pad. The hydraulic system may include an accumulator for receiving excess hydraulic fluid after a preset pressure has been reached in the system. Various hydraulic systems are possible.

10 Claims, 12 Drawing Figures

FIG. 2
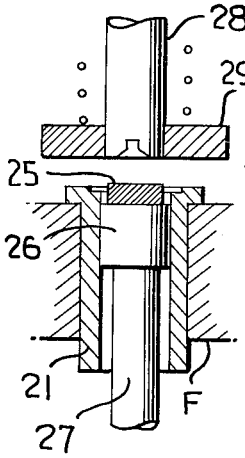
FIG. 3
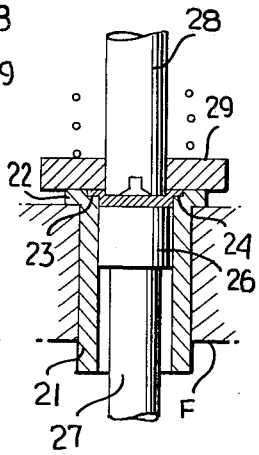
FIG. 4
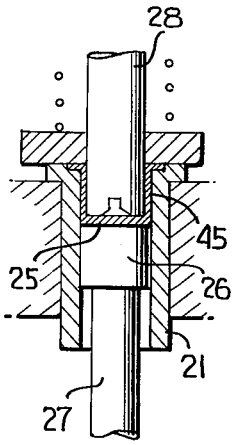
FIG. 5
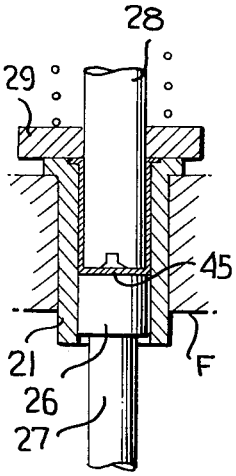
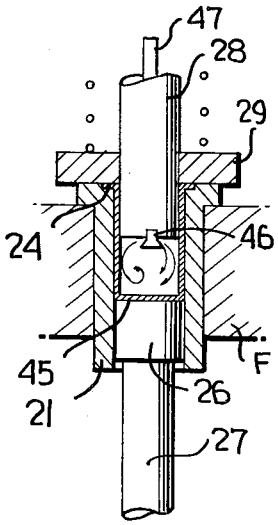
FIG. 6
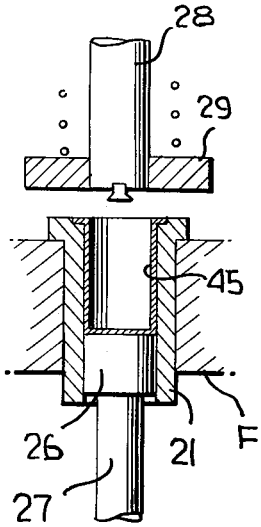
FIG. 7
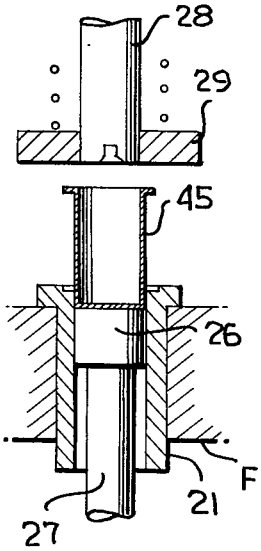
FIG. 8

PRESS WITH HYDRAULIC LOAD TRANSFERRING MECHANISM

This invention relates in general to new and useful improvements in drawing and forging presses, and more particularly to a press construction wherein a slug, as it is being forged into a tubular element, is moved through a die sleeve for a distance equal to the length or height of the forged tubular element.

When a slug is being forged over a long distance such as is required in the formation of a tubular element, the forging pressure must be maintained throughout the stroke of the press with the result that the workload demand on the press is extremely high. It has therefore been found to be impractical to utilize a conventional reciprocating crank type press for the formation of forged tubular elements.

It is known from the patent to Werner U.S. Pat. No. 2,417,794 to utilize the force exerted by a support pad to exert a holding force on a blank hold-down clamp. It has been found, in accordance with this invention, the broad principles of the Werner patent may be beneficially utilized in the forging of a tubular element from a slug by driving the ram through the force applied to the forging pad.

Most specifically, in forging processes where a slug is moved through a die sleeve for a distance equal to the length or height of the forged tubular element, a ram is provided with a punch which cooperates with a forging pad on which the slug to be forged is positioned. The ram is actuated by a crank mechanism which normally has associated therewith a flywheel.

In accordance with this invention, it is proposed to support the forging pad by a hydraulic cylinder with the piston of the hydraulic cylinder being movable generally with the ram during the forging operation. Most specifically, in accordance with this invention, the hydraulic cylinder carrying the forging pad, to be referred to hereinafter as the forging cylinder, is interconnected with at least one other hydraulic cylinder which acts on the ram to pull the ram down as the forging pad moves down under the influence of the punch. In this manner the force provided by the crank mechanism on the ram is decreased substantially while the required forging pressure on the slug is maintained.

Most specifically, in accordance with this invention, there are preferably two hydraulic load cylinders which are fixed at one end and connected at the opposite end to the ram for drawing the ram down. The forging cylinder functions as a pump under the influence of the force exerted therein by the forging pad and pumps hydraulic fluid into the load cylinders to draw the ram down and thus provide a major portion of the forging pressure. The cross sectional area of the forging cylinder is in excess of the cross sectional areas of the load cylinders whereby as the forging cylinder piston moves substantially in unison with the ram, hydraulic fluid will be forced out of the forging cylinder in a volume greater than the requirements of the load cylinder whereby the hydraulic fluid will be pressurized and thereby the load on the ram drive elements will be reduced.

It is proposed in accordance with this invention to incorporate in the hydraulic system for the load cylinders and the forging cylinder an accumulator. The accumulator will receive the excess hydraulic fluid and thus will serve both to restrict the greater pressure build-up after a predetermined pressure is obtained, and also to limit generally the maximum pressure on the forging and load cylinders.

It is also to be understood that while hydraulic fluid is normally considered to be incompressible, at very high pressures hydraulic oil does have a positive compressibility. With a small amount of entrained air the compressibility may be on the order of 0.65% per 1000 p.s.i. Because of the compressibility of the hydraulic fluid and the relatively small differences in the fluid displacement of the pistons of the forging cylinder and the load cylinders, it will be seen that the forging load which can be developed in the early portion of the work stroke of a press with an arrangement of the Werner type is very low.

It is to be understood that the press, while it relies heavily upon the hydraulic system for the exertion of forging pressure, does incorporate the usual crank mechanism for effecting the reciprocation of the ram, the reciprocation of the ram being a controlling factor in the operation of the press and the hydraulic control valves for the press being actuated in timed relation to the reciprocation of the ram by the crank mechanism.

With the above and other objects in view that will hereinafter appear, the nature of the invention will be more clearly understood by reference to the following detailed description, the appended claims, and the several views illustrated in the accompanying drawings.

IN THE DRAWINGS

FIGS. 2–8 are schematic sectional views through the tooling of the forging press of FIG. 1, and show various stages in the sequence of forging a slug into a closed end elongated tubular element.

Figure 1:
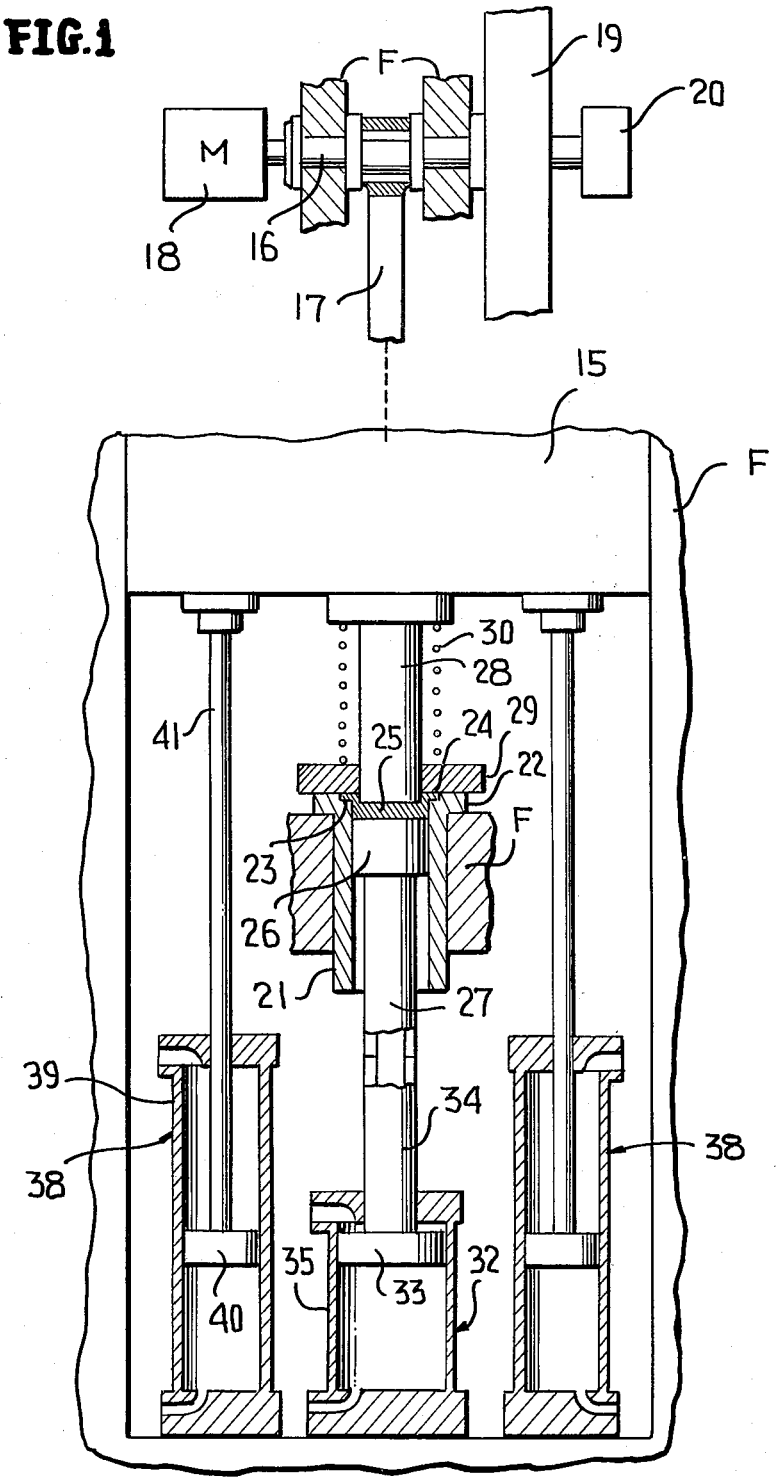
FIG. 1 is a schematic vertical sectional view taken through a forging press formed in accordance with this invention, and shows the general details thereof.

Referring now to the drawings in detail, it will be seen that there is illustrated in FIG. 1 the basic components of the forging press and the relationship thereof. The press includes a frame F in which a ram 15 is mounted for guided vertical reciprocating movement. The ram is reciprocated by means of a crank 16 which is journalled in an upper part of the frame and which carries a connecting rod 17 which is suitably attached to the ram. The crank 16 may be driven in any manner including by means of a suitable electric motor 18. The crank carries a flywheel 19 and may have coupled thereto a control unit 20.

An intermediate portion of the frame F carries a die sleeve 21. The die sleeve 21 includes an upper flange portion 22 having a counterbore 23 therein specifically configurated to form a flange 24 on the upper end of the tubular element which is being forged from an initially flat slug 25.

The slug 25 is seated on a pad 26 which is carried by a support 27 for vertical descending movement within the die sleeve 21 and return. The support 27 is, in turn, carried by a forging cylinder 32.

The tooling of the press, in addition to the die sleeve 21 and the pad 26, includes a punch 28 carried by the ram 15 for striking and forging the upper surface of the slug 25. A flange clamp 29 is carried by the punch 28 for relative vertical movement and is resiliently held in place against the flange 22 of the die sleeve by a spring 30. The forging cylinder includes a piston 33 carrying a piston rod 34 which may be part of or coupled to the support 27. The piston 33 is mounted within a cylinder 35 which is fixedly mounted.

As is clearly shown in FIG. 1, the ram 15 has attached thereto a pair of load cylinders which are anchored relative to the frame F. Each load cylinder 38 includes a cylinder 39 having a piston 40 mounted therein for reciprocating movement. The piston 40 carries a piston rod 41 which is secured to the underside of the ram 15. It is to be understood that hydraulic fluid will be directed into and out of the upper ends of the cylinders 39 while the lower ends of the cylinders 39 may be vented to the atmosphere.

In FIGS. 2–8, the sequential operation of the press formed in accordance with this invention is illustrated. As shown in FIG. 2, with the pad 26 in its uppermost position, the slug 25 is seated on the pad and the punch 28 and flange clamp 29 move downwardly.

In FIG. 3, the flange clamp 29 has bottomed on the flange 22 and the punch 28 has continued to move downwardly relative to the flange clamp, with the result that a portion of the slug 25 has been extruded to form the flange 24.

In FIG. 4 there is illustrated the continued downward movement of both the punch 28 and the pad 26, with the punch 28 moving slightly faster than the pad 26 in view of the thinning of the slug 25. A tubular body (can) 45 has begun to take shape.

In FIG. 5, the punch 28 has reached its bottom dead center position and the can 45 has been completed. While the pad 26 remains in its lower position and the flange clamp 29 remains in place, the punch 28 is withdrawn. Holding of the can 45 within the die sleeve 21 is assisted by an air jet directed from the bottom of the punch 28 through an air valve 46 formed therein. It is to be understood that the punch 28 has a bore extending therethrough and that a suitable air line 47, schematically illustrated, supplies air into the container 45 to hold it seated in the die sleeve 21.

In FIG. 7, the punch 28 has moved upwardly sufficiently to become completely clear of the formed can 45 and the flange clamp 29 is moving upwardly therewith. At this point the pad 26 begins its move upwardly and as it does move upwardly, the formed can 45 is pushed out of the die sleeve 21 as shown in FIG. 8. The punch 28 moves upwardly sufficiently to permit ease of removal of the can 45 and the placing of another slug 25 on the pad 26.

Figure 9:
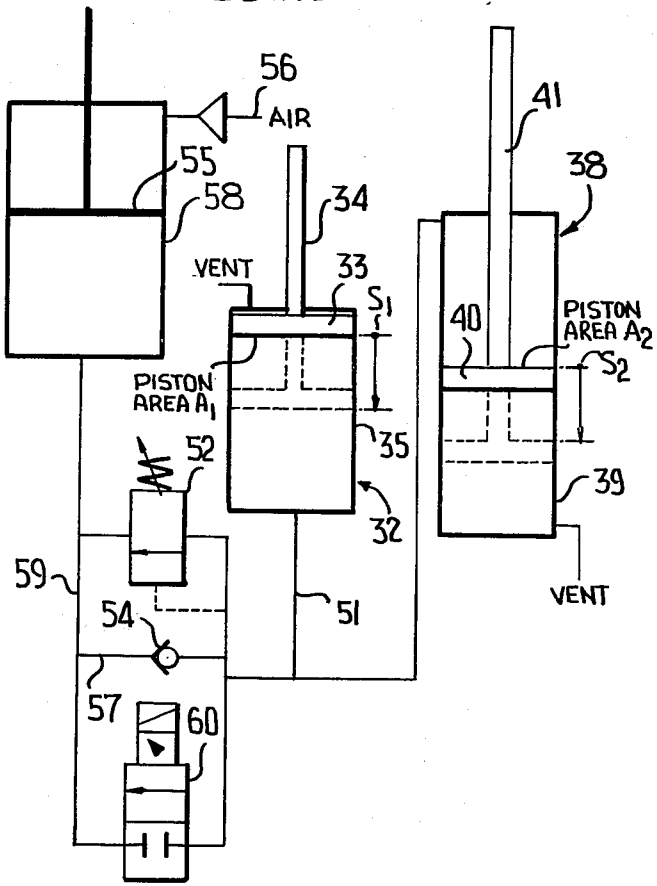
FIG. 9 is a schematic view of a basic hydraulic system in accordance with this invention.

Reference is now made to FIG. 9 which is a schematic illustration of a hydraulic system utilized in conjunction with a mechanical press which is primarily intended for use in a drawing operation where lighter loads are involved than in conjunction with forging as illustrated in FIGS. 2–8, but under certain conditions could be utilized for forging purposes. Accordingly, the system will be described in conjunction with a forging process.

When this system is used for drawing operations, the cylinder 32 functions solely as a support cylinder and provides a blank-supporting force on the downstroke and a stripping force on the upstroke. The behavior of this system during the working portion of the downstroke would be substantially the same if the press were used for container forging.

Although only a single load cylinder 38 has been illustrated, it is to be understood that normally there will be two load cylinders and a second load cylinder has not been illustrated.

A hydraulic line 50 extends from the upper end of the load cylinder 38 and is coupled to the lower end of the forging cylinder 32 by a line 51. Coupled to the line 50 remote from the forging cylinder is a relief valve 52 which remains closed unless the pressure in a line 53 coupled to the line 50 rises to a pressure for which the valve 52 is set. The setting of the valve 52 is selected to provide a pressure Pr which enables the forging cylinder 32 to furnish adequate drawing or forging forces depending upon the specific tooling and utilization of the press.

The hydraulic system also includes a reservoir 58 wherein hydraulic fluid is maintained under pressure under the influence of a piston 55 acted upon by an air supply 56. A line 59 is coupled to the reservoir 58 for receiving hydraulic fluid therefrom and directing hydraulic fluid thereinto.

The line 59 is connected in parallel to the line 53 and to the relief valve 52 for receiving hydraulic fluid from the relief valve 52.

A bypass line 57 extends between the lines 53 and 59 and has incorporated therein a check valve 54. The lines 53 and 59 are also coupled together by a drain valve 60 which is normally closed.

It is to be understood that as the ram 15 initially moves downwardly before the punch 28 contacts the slug 25, it is necessary that hydraulic fluid be delivered into the upper part of the load cylinder 38. During this portion of ram motion the check valve 54 passes oil from the pressurized reservoir 58 through the lines 59, 57, 53 and 50 into the cylinder 39. As the ram 15 continues to move downwardly, the punch 28 engages the slug 25 and forces the forging pad 26 downwardly with the result that the piston 33 of the forging cylinder 32 also moves downwardly. The upper end of the cylinder 35 is vented to the atmosphere so as to permit the piston 33 freely to move downwardly.

Inasmuch as the cross sectional area of the forging piston 33 is greater than that of the load cylinder piston(s) 40, it will be seen that as the pistons 33 and 40 move downwardly in substantial unison, the piston 40 being held against advance movement by the piston 33 due to the interconnections through the ram, punch, slug and forging pad, more hydraulic fluid will be pumped out of the forging cylinder 35 that can be received by the load cylinder. The check valve 54 prevents back flow of the fluid to the reservoir 58 and the valve 60 is in its closed position. The net results is a build-up of pressure in the two cylinders and the exertion of a high forging pressure on the slug disposed between the punch 28 and the forging pad 26.

When the pressure within the cylinders 32 and 38 exceeds that for which the relief valve 52 is set, the valve 52 will pass the excess hydraulic fluid to the reservoir 58 while maintaining the preset pressure in the cylinders 32 and 38. This continues until the ram 15 reaches its bottom dead center position of FIG. 5, at which time the valve 60 shifts to drain position for draining the line 50 back into the reservoir 58. It is to be understood at this time that the controller 20 will be utilized for the automatic actuation of the valve 60.

As the ram 15 begins to move upwardly due to a combination of the weight of the pad, support 27, piston rod 34 and piston 33, as well as the air pressure introduced into the can through the air valve 46, the piston 33 remains at its lowermost position while the ram and load cylinder piston move upwardly with the hydraulic fluid or oil flowing out of the load cylinder and back into the drain 38. This continues until the ram 28 reaches the position of FIG. 7, at which time the hydraulic oil being pumped from the load cylinder and the pressure of the oil in the reservoir 58 urge the piston 33 and the pad upwardly. At this time it is pointed out that the pressure of the air from the air supply 56 acting upon the piston 55 of the reservoir 58 may be selectively varied so as initially to receive in the reservior 58 returning hydraulic fluid at a very low pressure and wherein the pressure in the reservoir is increased so that the pressure acting on the underside of the piston 33 will be sufficient to move the piston 33 and the forging pad upwardly as shown in FIG. 8.

It is to be understood that the controller 20 may also be utilized for selectively controlling the air pressure exerted on the piston 55.

To understand the behavior of this system during the early positions of the forging stroke it should be recalled that gas-free hydraulic oil has a compressibility of about 0.5% per 1,000 p.s.i. of applied pressure. Normally the hydraulic oil will have a small amount of entrained air, and the compressibility will be higher, on the order of 0.65% per 1,000 p.s.i. Therefore, the volume reduction $\Delta V$ necessary to cause a volume of oil V to increase pressure by an amount P will be:

$$\Delta V\ 0.0065V\cdot(P/1000\ \text{psi}) \quad (1)$$

The effect of compressibility on forging load can be assessed by calculating the length of stroke required to develop full pressure. FIG. 9 shows the pertinent hydraulic components at the beginning of forging.

The work stroke of the forging cylinder 32 is less than that of the load cylinder 38 because the work material becomes thinner as the forging processes. The area of the piston 33 is selected to be larger than the area of the piston 40 so that more oil will be forced from the cylinder 32 than can enter the cylinder 38. At first the excess oil causes the pressure in the system to rise. After the pressure increases to Pr, all of the excess oil is driven through the relief valve 52 into the reservoir. The compressibility effects of interest occur during that portion of the forging cycle before the relief valve passes oil to the reservoir, i.e., during the pressure rise.

In FIG. 9, $S_1$ represents the movement of the piston 33 in the cylinder 32 during pressure rise and $S_2$ the movement of the piston 40 in the cylinder 38 during that interval. The oil volume in the system decreases by an amount:

$$\Delta V = A_1S_1 - A_2S_2 \quad (2)$$

Substituting from (1) for $\Delta V$ gives $$(0.0065Vp/1000\ \text{psi}) = A_1S_1 - A_2S_2 \quad (3)$$

In container forging: $S_1 \approx 0.95S_2$ $$A_1 = 12.567\ \text{in}^2,\ A_2 = 10.308\ \text{in}^2,\ \text{and}\ V \approx 200\ \text{in}^3$$

Substitution of these values in (3) gives:

$$S_2 \approx (0.0065)(200\ \text{in}^3)p/(1.6306\ \text{in}^2)(1000\ \text{psi}) = 0.797\ p/1000\ \text{psi} \quad (4)$$

With a relief valve setting $P_r = 3300$ p.s.i. and a system pressure of 100 p.s.i. at the time forging starts, $p = P_r - 100 = 3200$ p.s.i. and $S_2 \approx 2.55$ in.

This is almost 57% of the height of a container 4.5 in. tall.

The pressure rises linearly with distance $S_2$. Hence system pressure at the beginning of forging is only 100 p.s.i. and remains well below relief valve pressure for an appreciable portion of the work stroke.

It should be noted that $S_2$ will vary inversely with the height of the container. The reason for this is that the press has a fixed stroke. Therefore the quantity of oil in the cylinder 38 at the onset of forging varies inversely with container height. Hence V, the quantity of oil to be pressurized increases for shorter container. For example, with a container height of 2.4 inches, there would be about 21 in.$^3$ more oil to be pressurized. As a result, $S_2 \approx 2.82$ in., and full pressure would never be attained during the work stroke.

Figure 10:
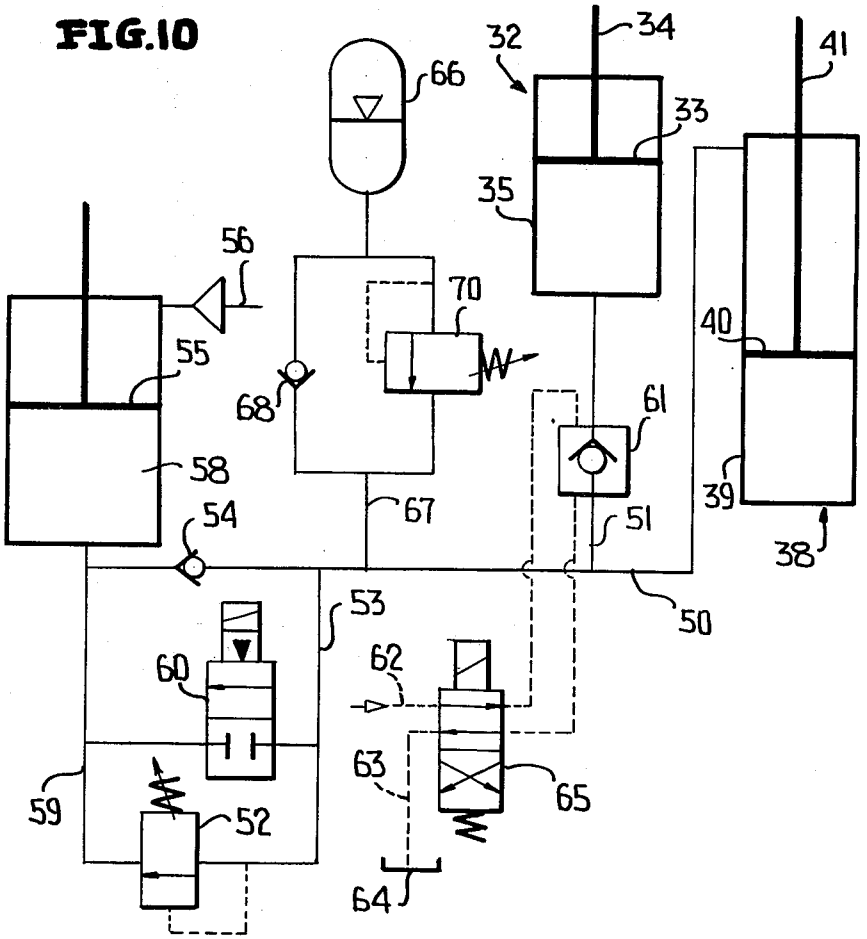
FIG. 10 is a schematic view similar to FIG. 9, and shows a more advanced hydraulic system.

Reference is now made to FIG. 10 wherein a modified hydraulic system is illustrated.

In FIG. 10 the hydraulic system generally shown in FIG. 9 is modified to the extent that the line 51 leading to the forging cylinder 32 is provided with a pilot controlled check valve 61, the check valve 61 being controlled by way of a pilot line 62 and a drain line 63 connected to a drain 64 for the hydraulic fluid. The control valve 65 controls actuation of the pilot controlled valve 61.

There has also been added an accumulator 66 which is coupled to the line 50 through a line 67. Between the accumulator 56 and the line 50 there is a check valve 68 and a pressure relief valve 70.

It is to be understood that in the initial phase of operation of the press with the hydraulic system of FIG. 10 the required make-up hydraulic fluid will be supplied to the load cylinder 38 from the reservoir 58 through the check valve 54. This continues until the punch 28 engages the slug 25 at which time the forging cylinder 32 is actuated and the piston 33 thereof is moved downwardly forcing hydraulic fluid through the check valve 61 into the line 50. Inasmuch as the output of the forging cylinder is greater than the capability of the load cylinder receiving hydraulic fluid, there will be a pressure build-up in the system with the result that the check valve 68 will be unseated when the pressure rises above that of the preset pressure within the accumulator 66. Thus the accumulator 66 provides a means for controllably maintaining the desired forging pressure within the system and at the same time provides a receptacle for the excess hydraulic fluid.

Should the pressure within the system exceed that for which the pressure relief valve is set. Certain of the hydraulic fluid will be bled back into the pressurized reservoir 58.

After the ram has reached its bottom dead center position and has begun to move upwardly, it is necessary to vent the system. Accordingly, the valve 60 is now opened to permit the hydraulic fluid being pumped by the load cylinder to enter into the pressurized reservoir. At this time the air pressure acting upon the piston 55 of the reservoir may be reduced if so desired.

Should the pressure within the accumulator 66 be above that of the setting of the relief valve 70, once the pressure within the system has become reduced below that presently within the accumulator, the accumulator will relieve its pressure through the relief valve 70. This continues until the punch has reached the position shown in FIG. 7, at which time the valve 65 is actuated to open the check valve 61 and permit hydraulic fluid to enter the forging cylinder and thus force the piston 33 and the forging pad 26 upwardly as shown in FIG. 8.

It is to be understood that the valves 60 and 65 as well as the control for the air 56 may be controlled by the controller 20.

Figure 11:
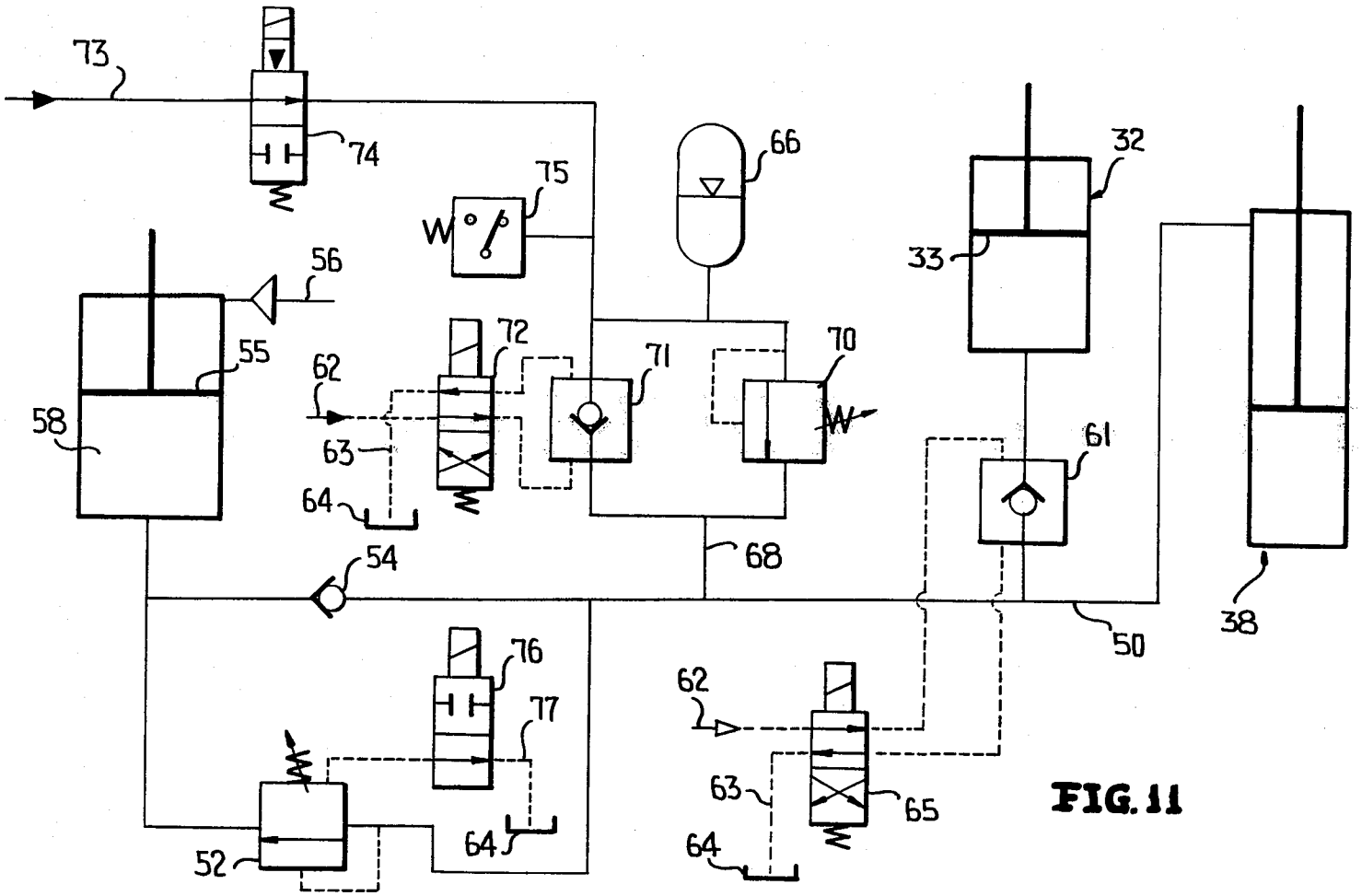
FIG. 11 is a schematic view similar to FIG. 10, and shows yet further refinements possible with the hydraulic system of FIG. 10.

Reference is now made to FIG. 11 which disclosed an improvement over the hydraulic system of FIG. 10. The hydraulic system of FIG. 10 has been improved by substituting a pilot controlled check valve 71 for the check valve 68 and there being a pilot valve 72 which controls the actuation thereof in the same manner as the pilot valve 65 controls the actuation of the check valve 61. In addition, there is an accumulator make-up supply line 73 coupled to the accumulator 66 through a valve 74. A pressure switch 75 is incorporated in the line 73 between the valve 74 and the accumulator 66.

The valve 60 has been replaced by a valve 76 which is associated with the pressure relief valve 52 and which is incorporated in a line 77 leading to the drain 64.

In the operation of the system of FIG. 11, as the ram 15 moves downwardly, hydraulic fluid is directed into the load cylinder 38 through the check valve 54 from the pressurized reservoir 58. This continues until the punch 28 engages the slug 25 at which time the forging pad 26 begins to move down, causing the piston 33 of the forging cylinder 32 to move down and to pump hydraulic fluid out of the forging cylinder 32 through the check valve 61 into the line 50. At the same time or slightly before the forging cylinder 32 is actuated, the pilot controlled check valve 71 opens to allow a small quantity of hydraulic fluid at thie pressure of the accumulator 66 to enter the system, thereby immediately pressurizing the system to a proper forging pressure.

Inasmuch as the pumping capacity of the forging cylider 32 is greater than the receiving capacity of the load cylinder 38, there will be a gradual build-up of pressure within the system above that initially provided for by the accumulator 66 with the result that hydraulic fluid will be pumped back into the accumulator through the check valve 71.

Should the pressure within the system exceed that for which the pressure relief valve 52 is preset, hydraulic fluid will be bled from the system back into the pressurized reservoir.

It is to be understood that when the ram 15 has reached its bottom dead center position and has begun to move upwardly, the load cylinder 38 begins to pump fluid back into the system. At this time control valve 76 vents relief valve 52, thereby permitting fluid to flow freely through valve 52 back to reservoir 58.

It is also to be understood that pressure within the accumulator 66 is relieved at this time through the pressure relief valve 70.

In the event the pressure within the accumulator system 66 should drop below a preset pressure, the pressure switch 75 will be actuated to open the valve 74 and to resupply the accumulator 66.

While the system of FIG. 11 permits pressurization at the onset of forging, it does not permit independent selection of initial pressurization level and general forging pressure. It is especially difficult to adjust the various systems parameters to provide high forging pressure on the order of 3500/4000 p.s.i., but only moderate pressurization on the order of 1500/2000 p.s.i.

Figure 12:
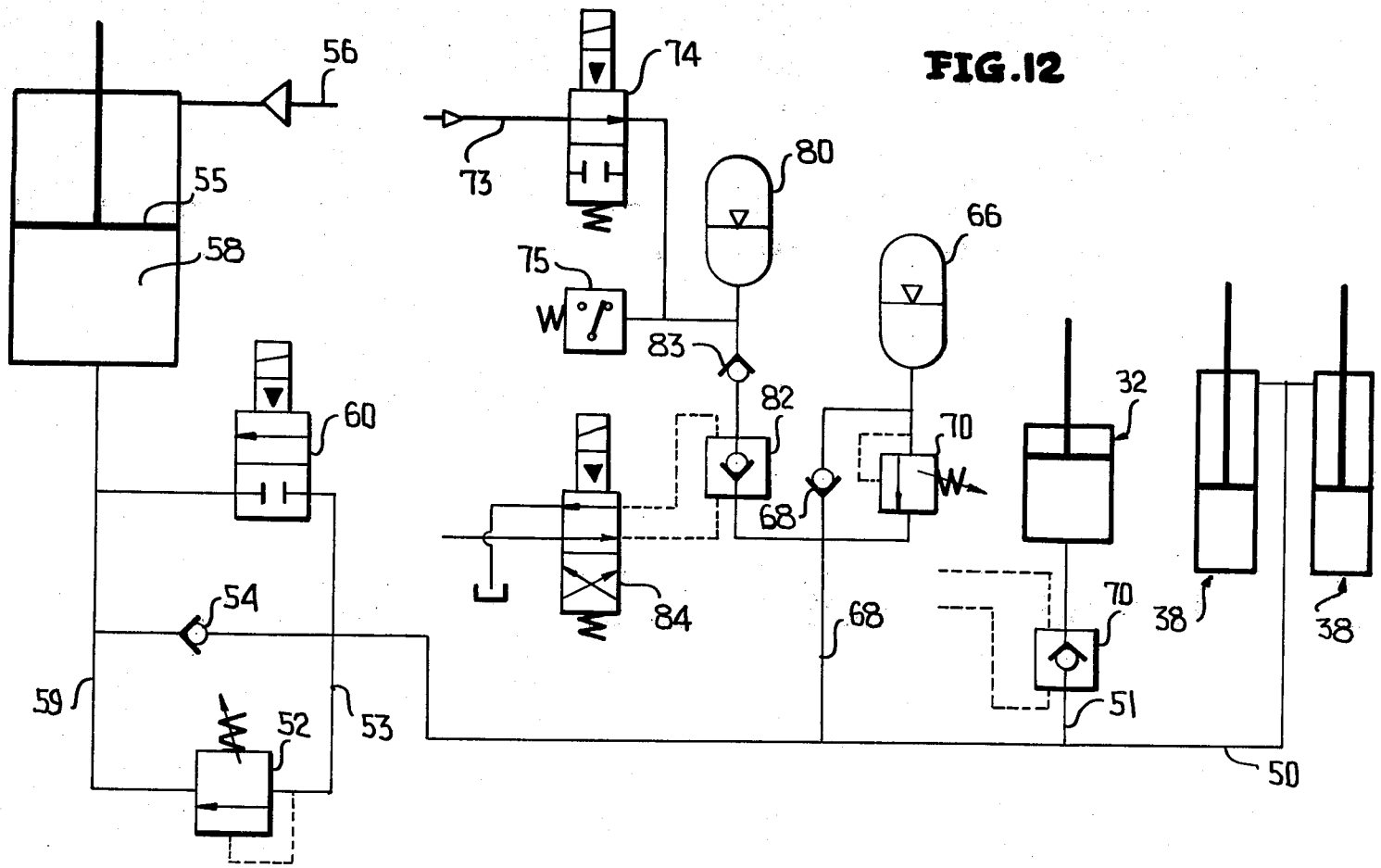
FIG. 12 is also a schematic view similar to FIG. 10, and shows yet further refinements of the hydraulic system.

Referring now to FIG. 12, it will be seen that a further modification of the hydraulic system is illustrated. The system corresponds generally to that of FIG. 11 with the make-up supply for the accumulator 66 eliminated and the check valve 71 again being replaced by the simple check valve 68 of FIG. 10. There has been added a second accumulator 80 which is coupled to the line 68 by a line 81. The line 81 has incorporated therein a pilot controlled check valve 82 and a conventional check valve 83, the valve 83 being the closest to the accumulator 80.

It will be noted that the hydraulic system of FIG. 12 has separate accumulators for pressurization and forging. For pressurizing fluid is drawn from the accumulator 80 while during the forging stroke fluid is driven into the accumulator 66 in the previously disclosed manner.

It is also to be understood that the make-up supply for the accumulator is no longer associated with the accumulator 66, but is associated with the accumulator 80. Thus the accumulator supply line 73 is coupled in the line 81 between the check valve 83 and the accumulator.

It is to be understood that the pilot controlled check valve 82 is actuated or controlled by a pilot valve 84 which corresponds to the pilot valve 65 and the previously disclosed pilot valve 72.

Although several embodiments of the hydraulic system have been specifically illustrated and described herein, it is to be understood that minor variations may be made in the press arrangements and the hydraulic systems without departing from the spirit and scope of the invention as defined by the appended claims.

I claim:

1. A forging press assembly comprising a ram actuatable by a mechanical reciprocating drive, a punch carried by said ram for reciprocation therewith, a fixed die sleeve for receiving said punch, a forging pad received in said die sleeve for cooperation with said punch, a forging cylinder supporting said forging pad, at least one load cylinder coupled to said ram for applying a forging load on said punch through said ram, and a hydraulic system coupled to said load cylinder and said forging cylinder, said hydraulic system including hydraulic lines for transferring hydraulic fluid between said forging cylinder and said load cylinder in response to movement of said ram and said forging pad, first means for introducing a low pressure hydraulic fluid to said load cylinder and said forging cylinder, and second means for increasing the pressure of the hydraulic fluid in at least said load cylinder during product forging.

2. The forging press assembly of claim 1 wherein said second means includes said load cylinder having an effective cross section lesser than the cross section of said forging cylinder.

3. The forging press assembly of claim 2 wherein said hydraulic system includes pressure relief means for controllably limiting pressure within said load cylinder and said forging cylinder during forging.

4. The forging press assembly of claim 3 wherein said pressure relief means is in the form of an accumulator.

5. The forging press assembly of claim 4 wherein said pressure relief means includes a check valve opening into said accumulator and a relief valve in parallel with said check valve for restoring pressure within said accumulator to a preselected starting level after each forging operation.

6. The forging press assembly of claim 5 wherein said check valve is a selectively controllable valve wherein hydraulic fluid from said accumulator may be introduced at high pressure into said load cylinder to provide means for initially pressurizing said load cylinder.

7. The forging press assembly of claim 5 wherein said check valve is a selectively controllable valve wherein hydraulic fluid from said accumulator may be introduced at high pressure into said load cylinder to provide means for initially pressurizing said load cylinder at the time of product forging initiation.

8. The forging press assembly of claim 4 wherein there is a second accumulator coupled to said load cylinder for pressurizing hydraulic fluid in said load cylinder at the initiation of product forging.

9. The forging press assembly of claim 1 wherein there is a check valve normally preventing fluid flow into said forging cylinder.

10. The forging press assembly of claim 9 wherein there are control means for selectively opening said check valve to permit return fluid flow into said forging cylinder.

* * * * *